United States Patent [19]

Morris

[11] 3,970,056

[45] July 20, 1976

[54] VARIABLE COMPRESSION RATIO CONTROL SYSTEM FOR INTERNAL COMBUSTION ENGINES

[76] Inventor: Kenneth B. Morris, 4213 Belmar Blvd., Neptune, N.J. 07753

[22] Filed: Oct. 11, 1974

[21] Appl. No.: 514,105

[52] U.S. Cl. ..... 123/48 D; 123/78 R; 123/78 AA

[51] Int. Cl.[2] ..... F02B 75/36

[58] Field of Search..... 123/48 D, 78 D, 78 AA, 123/48 R, 78 R

[56] References Cited

UNITED STATES PATENTS

| | | | |
|---|---|---|---|
| 1,009,482 | 11/1911 | Cunningham | 123/78 R |
| 1,167,023 | 1/1916 | Schmidt | 123/78 R |
| 1,979,746 | 11/1934 | Kenneweg | 123/78 AA |
| 2,114,924 | 4/1938 | Kahllenberger | 123/78 R X |
| 2,157,486 | 5/1939 | Geisslinger et al. | 123/78 AA |
| 2,387,973 | 10/1945 | Aspin | 123/78 AA |
| 2,712,304 | 7/1955 | Troberg | 123/48 D |
| 2,728,332 | 12/1955 | Troberg | 123/48 D |
| 2,890,688 | 6/1959 | Goiot | 123/48 D |
| 2,970,581 | 2/1961 | Georges | 123/191 SP X |
| 3,220,387 | 11/1965 | Creager | 123/48 D X |

FOREIGN PATENTS OR APPLICATIONS

| | | | |
|---|---|---|---|
| 633,347 | 12/1949 | United Kingdom | 123/78 R |

*Primary Examiner*—Charles J. Myhre
*Assistant Examiner*—William C. Anderson
*Attorney, Agent, or Firm*—Howard T. Jeandron

[57] ABSTRACT

The internal combustion engine comprises one or more cylinders in which a main piston provides the means to drive a drive shaft, there is a cylinder head over the cylinders. Auxiliary pistons slide in each auxiliary cylinder in the cylinder head and each communicating with the main cylinder. The auxiliary piston moves up or down to change the compression ratio of each cylinder, each auxiliary cylinder is ported with a hydraulic pressure fluid supply for movement of the auxiliary piston to increase compression and ported to an exhaust to decrease compression, said porting is controlled by a differential resolver that is actuated by the throttle.

6 Claims, 4 Drawing Figures

VARIABLE COMPRESSION RATIO CONTROL SYSTEM FOR INTERNAL COMBUSTION ENGINES

This invention relates to a variable compression ratio system for an internal combustion engine having an auxiliary cylinder and a mechanical system of rods and levers. In this system for variable compression ratio internal combustion engines, there is one or more combustion cylinders in which the pistons are designed to produce a full power operating stroke for each cycle of combustion and in which a small auxiliary cylinder is interconnected at the top of each of the engine cylinders and provided with an auxiliary piston that moves toward or away from the main cylinder to vary the combustion area and thus change the compression ratio, this is accomplished by the actuating mechanism (throttle) which imparts to the auxiliary piston a relative movement to retain the auxiliary piston in one position for full compression ratio and to adjust or vary the travel of the auxiliary piston to provide lesser compression ratio according to the demand.

It is to be understood that with a variable compression ratio of the engine, the compression ratio may be increased for low power operation and decreased for high power operation.

It is an object of this invention to provide a control system to change the compression ratio of an internal combustion engine during engine operation and operate the engine with an increase compression when less power is required and provide a self-adjusting means to reduce compression for starting the engine and for high power demand.

It is a further object of this invention to provide a control system utilizing the throttle or manifold pressure as the ratio input through a differential resolving element to control the position of each displacement piston in each auxiliary cylinder that is aligned with and open to each cylinder of an engine as a means of varying the compression ratio.

Figure 1:
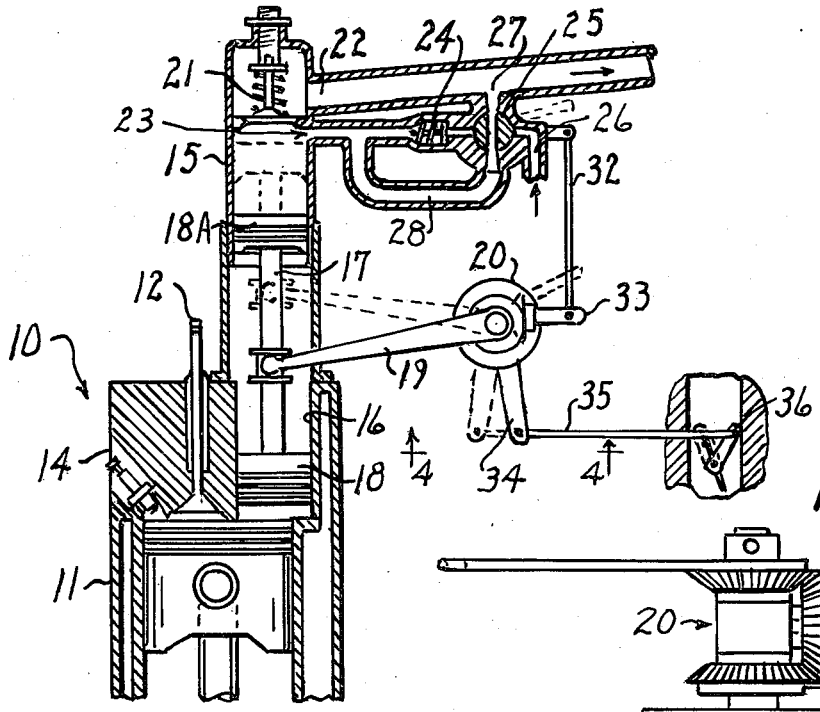
Figure 4:
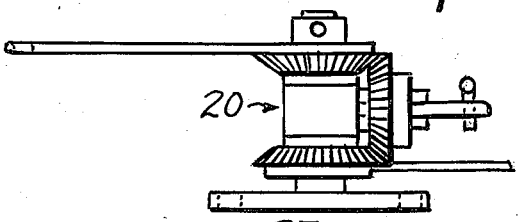
Figure 2:
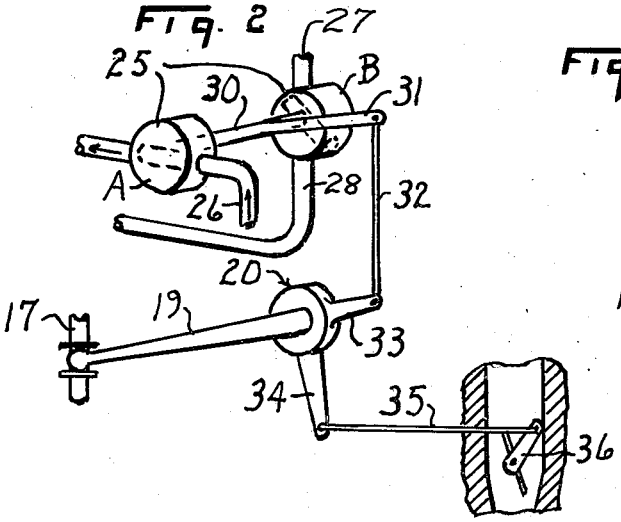
Figure 3:
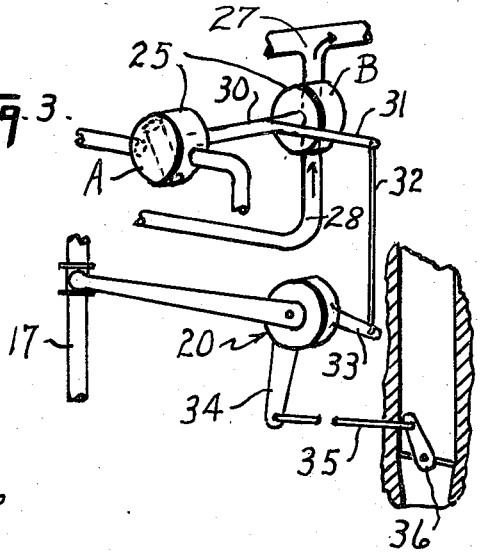

Further objects of this invention shall be apparent by reference to the accompanying detailed description and the drawings in which FIG. 1 is a cutaway schematic illustration of the apparatus, of a combustion cylinder and an engine, with an auxiliary cylinder in line and connected thereto and having an auxiliary piston that floats therein and is connected by a piston rod, FIG. 2 is a cutaway schematic showing the differential control in a position to charge one side of the displacement piston, FIG. 3 is a cutaway schematic showing the differential control in an opposite position to discharge the one side of the displacement piston, and FIG. 4 is an enlarged view taken on line 4—4 of FIG. 1.

With all internal combustion engines and particularly automotive engines, full power is only required a small percentage of the operating time. The engines now used, that is, the compression ratio of the engines now used, is determined to provide full power operating conditions. With most drivers of automotive engines, a fixed ratio engine falls far short of achieving maximum efficiency. Compression ratio can have a significant affect on internal combustion engine efficiency. To effect a means of varying the compression ratio, the following system has been devised.

Referring to FIG. 1 there is illustrated an internal combustion engine cylinder 10 having its normal components of a piston 11, intake and exhaust valves 12 and ignition by a spark plug 14. Thus the engine will operate in a normal fashion with the piston 11. With the variable compression ratio system illustrated there is an auxiliary cylinder 15 mounted at the top of cylinder 10 and in line with the operation of piston 11. There is also a bore 16 provided from the top of cylinder 10 to the top of the open chamber to the top of the open chamber of the cylinder. A piston rod 17 with a piston head 18 and 18A is mounted on either end of rod 17, the head 18 having a reciprocating movement in the bore 16 and the head 18A having a reciprocating movement in the cylinder 15. Rod 17 is also provided with a central means for mounting a movable lever 19 which provides a means of imparting feed back information from this combination. Rod 19 is pivotally affixed to a differential resolver 20. Cylinder 15 is provided with a quick relief valve 21 to relieve excessive pressure if it is developed and an exhaust port 22 is connected to the relief valve 21. A port 23 is connected to the top of cylinder 15, port 23 being connected to a check valve 24 and the opposite side of the check valve connected to a rotary valve 25 and the rotary valve being connected to an intake port 26. The rotary valve 25 is actually two valves A and B, FIG. 2. The B valve is connected through a port 27 to the exhaust port 22. The opposite side of the B valve is connected through a pipe 28 to port 23. Both rotary valves A and B are controlled by a single shaft 30. Shaft 30 is affixed to a control arm 31 to control the rotation of valves A and B. Arm 31 is connected by a link 32 to an arm 33 of the differential resolver 20. The differential resolver 20 also is provided with an arm 34 which is connected by a link 35 to the throttle valve 36 in the carburetor of the engine system. The operation of the throttle therefore controls the movement of the differential resolver 20 and in turn the differential resolver will produce the movement of the rotary valves 25A and B and also the differential resolver by means of arm 19 will provide a movement of the piston rod 17 and pistons 18 and 18A. However piston 18 is movable by the compression of piston 11 on its compression and power stroke. And, when there is an exhaust stroke on piston 11, piston rod 17 and its piston 18A are movable downward. When the rotary valve 25A is in an open throttle position as indicated in FIG. 2, due to port 26 being connected to an oil or hydraulic fluid pressure line, the hydraulic fluid passing through valve 25A opening the check valve 24 and acting on the piston 18A to push it downward. The fluid pressure cannot pass through 28 as the valve 25B is in a closed position as indicated in FIG. 2. In a closed throttle position when throttle 36 is moved to the closed position as illustrated in FIG. 1, the differential resolver is moved as indicated and the arm 33 and link 32 pulls downward on arm 31 and thus rotates valves 25A and B changing their position so that valve B will be open and valve A will be closed, FIG. 3. Thus on a power stroke with the movement of piston 18 upward, the fluid above piston 18A will be pushed out port 23 through 28 and through valve 25B to be exhausted through port 22 back to the automotive crank case. Thus it is apparent that with normal operation of cylinder 10 and with piston 11 moving there will be effected a movement of piston 18 by the engine pressure on piston 18 and also by the return pressure of the hydraulic fluid on piston 18A. Thus the actual combustion space above piston 11 will be continually increasing or decreasing by the movement of piston 18. It is to be noted that piston 18 cannot move downward during a power stroke but will not move upward more than a desired degree due to the check valve 21.

It is to be noted that piston 18 is necessarily smaller in its pressure area than the main piston as illustrated in FIG. 1.

Although we have controlled or affected the movement of the auxiliary cylinder by a throttle which may be similarly controlled by manifold pressure, by venturi velocity or by engine R.P.M. or a combination of two or more of these functions, it is apparent that with this system and its component parts that a variable compression ratio is produced and effects an increased compression (18 moving downward) for low power operation and a reduced compression (18 moving upward) for high power operation, however the auxiliary piston does not move in its cylinder unless there is a power demand change. It is also apparent that the compression ratio is variable during engine operation so that there is an increased compression when less power is required and it automatically adjusts to provide decreased compression for full power operation. With this system the compression ratio will automatically go to low compression during starting of engine if throttle is partly opened. The position of the auxiliary piston varies according to power demand. With this system it is possible to have a compression ratio of say 8:1 to 25:1. It is desirable to operate the internal combustion engines with the ratio which is just below detonation point at all times to achieve maximum efficiency. With this variable adjusting means maximum efficiency may be obtained.

Although we have described the operation with a single cylinder it is simply a matter of providing the same control for each added cylinder. However on a multi-cylinder engine displacement pistons should be linked together to insure even compression on all cylinders for a smooth operation.

Although we have described this for a single cylinder, it may also be applied to multiple cylinders and a two stroke internal combustion or a four stroke engine.

The invention described in detail in the foregoing specification is subject to changes and modifications without departing from the principle and spirit thereof. The terminology used is for purposes of description and not of limitation; the scope of the invention being defined in the claims.

What is claimed is:

1. A variable compression ratio internal combustion engine controlled by a throttle comprising, a main cylinder block with a cylinder bore and a cylinder head over said cylinder bore, a piston reciprocatingly mounted in said cylinder bore, a combustion space between said piston and said cylinder head, a passage for compressed combustible gases passing through said cylinder head, said passage connected to a separate second cylinder in which a first auxiliary piston is slidably mounted, said auxiliary piston supported on a piston rod, said piston rod extending to a second auxiliary piston that is also reciprocatingly mounted so that both pistons float in opposed relationship in said separate cylinder, said first and second auxiliary pistons movable in said separate cylinder away from said combustion area when there is an increased pressure in said main cylinder, and a check valve in said cylinder to limit the degree of movement, a hydraulic fluid pressure system controlled by the throttle that is in turn connected to a differential resolver, said differential resolver controlling a rotary valve through which the hydraulic fluid pressure passes to one end of said second cylinder to act upon said second auxiliary piston, said fluid pressure acting upon the second auxiliary piston producing a floating motion of both first and second auxiliary pistons between a maximum compression and a minimum compression to in turn vary the position of the first auxiliary piston and in turn vary the compression in the combustion area, said second cylinder having a stop at one end to limit the movement of said first auxiliary piston when said combustion area of said main cylinder is exhausted of its pressure charge.

2. An engine according to claim 1 in which the variable compression ratio internal combustion engine is a straight four stroke engine.

3. An engine according to claim 1 wherein the superficial area of the auxiliary piston is smaller than the superficial area of the main piston, and the volume swept by the auxiliary piston is a small percentage of the volume swept by the main piston to maintain the desired range of compression.

4. An internal combustion engine according to claim 1 wherein the auxiliary piston is moved to vary the volume between the main piston, cylinder head and auxiliary piston.

5. In a device according to claim 1 in which the fluid pressure system is controlled by manifold pressure.

6. In a device according to claim 1 in which the fluid pressure system is controlled by the engine R.P.M.

* * * * *